US007580032B2

(12) United States Patent
Jung et al.

(10) Patent No.: US 7,580,032 B2
(45) Date of Patent: Aug. 25, 2009

(54) DISPLAY DEVICE AND DRIVING METHOD THEREOF

(75) Inventors: Ho-Yong Jung, Suwon-si (KR); Cheol-Woo Park, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 684 days.

(21) Appl. No.: 11/261,852

(22) Filed: Oct. 28, 2005

(65) Prior Publication Data

US 2006/0119559 A1 Jun. 8, 2006

(30) Foreign Application Priority Data

Dec. 13, 2004 (KR) ..... 10-2004-0105021

(51) Int. Cl.
*G09G 5/00* (2006.01)

(52) U.S. Cl. ..... 345/204; 345/94; 345/96

(58) Field of Classification Search ..... 345/42, 345/87, 92, 94, 96, 99, 100, 204, 209; 349/101
See application file for complete search history.

(56) References Cited

U.S. PATENT DOCUMENTS

| | | | | |
|---|---|---|---|---|
| 5,058,998 | A * | 10/1991 | Yoshida et al. | 349/101 |
| 5,648,793 | A * | 7/1997 | Chen | 345/96 |
| 6,219,019 | B1 | 4/2001 | Hasegawa et al. | |
| 6,496,172 | B1 | 12/2002 | Hirakata et al. | |
| 6,563,482 | B1 | 5/2003 | Yamazaki et al. | |
| 6,628,253 | B1 | 9/2003 | Hiroki | |
| 2002/0041267 | A1 * | 4/2002 | Jung | 345/92 |
| 2002/0140661 | A1 * | 10/2002 | Miyajima et al. | 345/96 |
| 2002/0154085 | A1 * | 10/2002 | Kim | 345/96 |
| 2002/0163488 | A1 * | 11/2002 | Song et al. | 345/87 |
| 2003/0030615 | A1 * | 2/2003 | Maeda et al. | 345/90 |
| 2003/0058375 | A1 * | 3/2003 | Moon et al. | 349/42 |
| 2003/0090449 | A1 * | 5/2003 | Arimoto et al. | 345/87 |
| 2003/0197672 | A1 * | 10/2003 | Yun et al. | 345/99 |
| 2004/0021625 | A1 * | 2/2004 | Lee | 345/87 |

FOREIGN PATENT DOCUMENTS

| | | |
|---|---|---|
| JP | 10333118 | 12/1998 |
| JP | 2003295157 | 10/2003 |
| JP | 2004061590 | 2/2004 |
| JP | 2004139078 | 5/2004 |
| KR | 1020010036308 | 5/2001 |
| KR | 100350651 | 8/2002 |
| KR | 100367432 | 12/2002 |
| KR | 1020040016029 | 2/2004 |
| KR | 1020040020431 | 3/2004 |
| KR | 1020040042484 | 5/2004 |
| KR | 1020040069015 | 8/2004 |

* cited by examiner

*Primary Examiner*—Amare Mengistu
*Assistant Examiner*—Premal Patel
(74) *Attorney, Agent, or Firm*—Cantor Colburn LLP

(57) ABSTRACT

A display device is provided including a plurality of pixels, a gate driver applying gate signals to the pixels, a data driver applying data voltages to the pixels, and a signal controller outputting a plurality of control signals for controlling the gate driver and the data driver. The polarity of a data voltage applied to a predetermined pixel is changed at least every two frames.

25 Claims, 7 Drawing Sheets

DISPLAY DEVICE AND DRIVING METHOD THEREOF

This application claims priority to Korean Patent Application No. 10-2004-0105021, filed on Dec. 13, 2004 and all the benefits accruing therefrom under 35 U.S.C. §119, and the contents of which in its entirety are herein incorporated by reference.

BACKGROUND OF THE INVENTION (a) Field of the Invention

The present invention relates to a display device and a driving method thereof.

(b) Description of the Related Art

A liquid crystal display ("LCD") includes a pair of panels provided with field generating electrodes, and a liquid crystal ("LC") layer disposed between the two panels and having dielectric anisotropy. The field generating electrodes generally include a plurality of pixel electrodes on one of the panels arranged in a matrix and connected to switching elements such as thin film transistors ("TFTs") to be supplied with data voltages for every row, and a common electrode on the other panel covering an entire surface of the panel and supplied with a common voltage. A pair of field generating electrodes that generate the electric field in cooperation with each other and a liquid crystal disposed therebetween form a so-called liquid crystal capacitor that is a basic element of a pixel along with a switching element.

The LCD has a frame frequency of about 60 Hz, and applies the voltages to the field generating electrodes to generate an electric field to the liquid crystal layer, and the strength of the electric field can be controlled by adjusting the voltage across the liquid crystal capacitor. Since the electric field determines orientations of liquid crystal molecules within the liquid crystal layer and the molecular orientations determine the transmittance of light passing through the liquid crystal layer, the light transmittance is adjusted by controlling the applied voltages, thereby obtaining desired images.

In order to prevent image deterioration due to long-term application of the unidirectional electric field, etc., polarity of the data voltages with respect to the common voltage is reversed every frame, every row, or every pixel.

Polarity inversion of the data voltages increases the charging time of the liquid crystal capacitor because of the response time of the liquid crystal. Therefore, it takes a relatively long time for the liquid crystal capacitor to reach a target luminance (or target voltage) such that an image displayed by the LCD is unclear and blurred.

In order to solve this problem, impulsive driving that inserts a black image for a short time between normal images has been developed.

Impulsive driving includes an impulsive emission type of driving that periodically turns off a backlight lamp to yield black images, and a cyclic resetting type of driving that periodically applies a black data voltage for making the pixels become a black state between the applications of normal data voltages to the pixels.

However, these techniques cannot compensate the large response time of the liquid crystal, and the response time of the backlight lamp is relatively large as well. Therefore, afterimages and flickering are generated which deteriorates image quality. In addition, the cyclic resetting type of driving may decrease the time for applying normal data voltages for displaying normal images such that the liquid crystal capacitors do not reach a target luminance, and thus an image displayed by the LCD is unclear and blurred.

BRIEF SUMMARY OF THE INVENTION

The present invention solves the problems of conventional techniques.

In an exemplary embodiment of the present invention, a display device is provided including a plurality of pixels, a gate driver applying gate signals to the pixels, a data driver applying data voltages to the pixels, and a signal controller outputting a plurality of control signals for controlling the gate driver and the data driver, wherein polarity of a data voltage applied to at least one pixel is changed at least every two frames.

The display device may have a frame frequency of 120 Hz.

Each gate signal may include a gate-off voltage, a first gate-on voltage, and a second gate-on voltage, and the gate driver may output the second gate-on voltage after a predetermined time has elapsed from the first gate-on voltage, and the first gate-on voltage is outputted only when the polarity of the data voltage applied to the at least one pixel is opposite to the polarity of a data voltage applied in a previous frame.

The display device may be a 1×1 dot inversion type.

The predetermined time may be 2H.

The display device may be a 2×1 dot inversion type.

The predetermined time may be 4H.

The plurality of control signals may include an inversion signal, and the data driver may invert the polarity of the data voltage based on the inversion signal.

The control signals may further include a scanning start signal, and the scanning start signal may include a first pulse for instructing output of the first gate-on voltage and a second pulse for instructing output of the second gate-on voltage.

The first gate-on voltage may be a precharging gate-on voltage, and the second gate-on voltage may be a main charging gate-on voltage. A plurality of precharging gate-on voltages may be provided within each gate signal.

The polarity of a data voltage applied to the at least one pixel may be the save for even frames, and opposite for odd frames.

The polarity of a data voltage applied to the at least one pixel may alternate between being the same for n consecutive frames and opposite for m consecutive frames, where n and m are greater than or equal to two, and where n may equal m.

The display device may be a liquid crystal display.

In a further embodiment of the present invention, a driving method of a display device including a plurality of pixels connected to a plurality of gate lines and a plurality of data lines is provided including applying a data voltage to the data lines, applying a first gate-on voltage and a second gate-on voltage to a first gate line to apply the data voltages to pixels connected to the first gate line when a polarity of a data voltage for a frame is different from a polarity of data voltages for a previous frame, and applying a second gate-on voltage and not the first gate-on voltage to the first gate line, to apply data voltages to pixels connected to the first gate line when a polarity of the data voltage for a frame is equal to a polarity of data voltages for a previous frame.

The display device may be an N row inversion type, and the gate driver may transmit the first gate-on voltage by (2N)H before transmission of the second gate-on voltage.

Data voltages applied at adjacent data lines may have polarities opposite to each other.

The display device may be a 1×1 dot inversion type.

The display device may be a 2×1 dot inversion type.

The display device may have a frame frequency of 120 Hz.

When the polarity of a data voltage for a frame is different from the polarity of a data voltage for a previous frame, a first gate-on voltage and a second gate-on voltage may be applied to a second gate line, and a first gate-on voltage and a second gate-on voltage may be applied to a third gate line, wherein the first gate-on voltage applied to the third gate line is the same as the second gate-on voltage applied to the first gate line.

When the polarity of a data voltage for a frame is different from the polarity of a data voltage for a previous frame, a first gate-on voltage and a second gate-on voltage may be applied to a fifth gate line, wherein the first gate-on voltage applied to the fifth gate line is the same as the second gate-on voltage applied to the first gate line.

In a further embodiment of the present invention, a display device includes at least one pixel, wherein a polarity of a data voltage applied to the at least one pixel alternates between being same for at least two consecutive frames and opposite for at least two consecutive frames.

When a polarity of a data voltage applied to the at least one pixel in an mth frame is opposite to a polarity of a data voltage applied in a previous frame, a precharging gate-on voltage and a main charging gate-on voltage may be applied to a first gate line of the display device.

When a polarity of a data voltage applied to the at least one pixel in an nth frame is same as a polarity of a data voltage applied in a previous frame, a main charging gate-on voltage may be applied to the first gate line without a precharging gate-on voltage.

A plurality of precharging gate-on voltages may be applied to the first gate line during the mth frame.

The main charging gate-on voltage may be applied subsequent the precharging gate-on voltage after a predetermined horizontal period.

BRIEF DESCRIPTION OF THE DRAWINGS

The present invention will become more apparent by describing embodiments thereof in detail with reference to the accompanying drawings, in which.

DETAILED DESCRIPTION OF THE INVENTION

Figure 1:
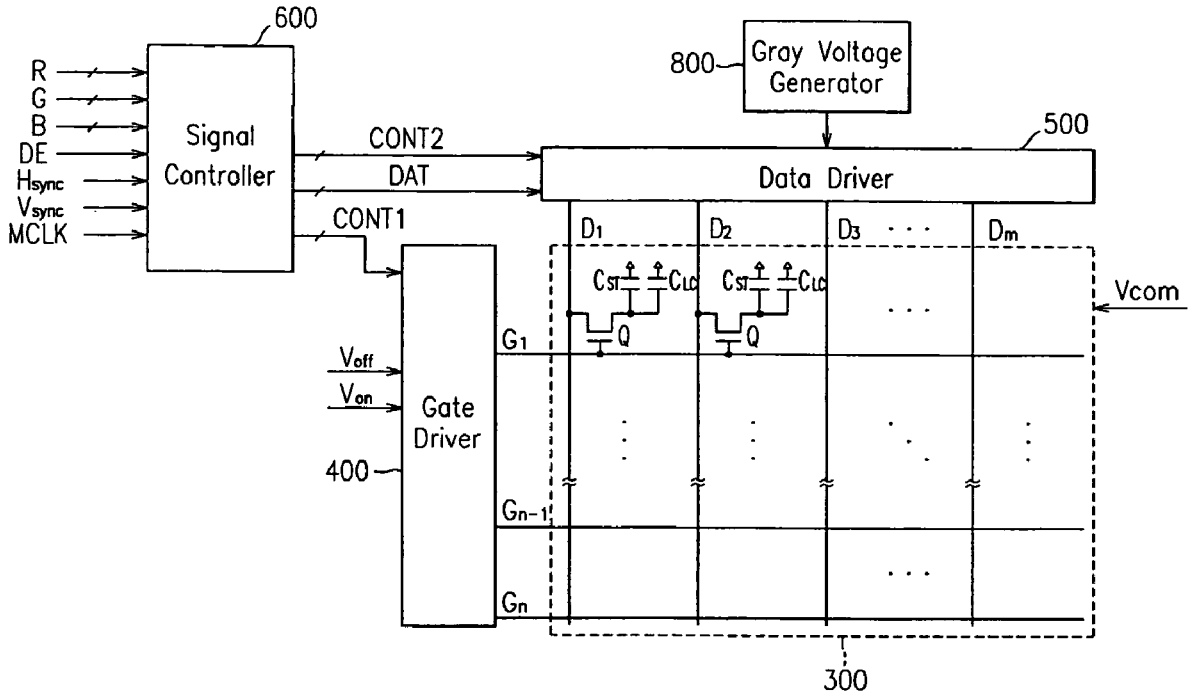
FIG. 1 is a block diagram of an exemplary embodiment of an LCD according to the present invention.

The present invention will be described more fully hereinafter with reference to the accompanying drawings, in which preferred embodiments of the invention are shown.

In the drawings, the thickness of layers and regions are exaggerated for clarity. Like numerals refer to like elements throughout. It will be understood that when an element such as a layer, region, or substrate is referred to as being "on" another element, it can be directly on the other element or intervening elements may also be present. In contrast, when an element is referred to as being "directly on" another element, there are no intervening elements present.

Liquid crystal displays and driving methods thereof according to embodiments of the present invention will be described with reference to the accompanying drawings.

An exemplary embodiment of a liquid crystal display ("LCD") according to the present invention is now described in detail with reference to FIGS. 1 and 2.

Figure 2:
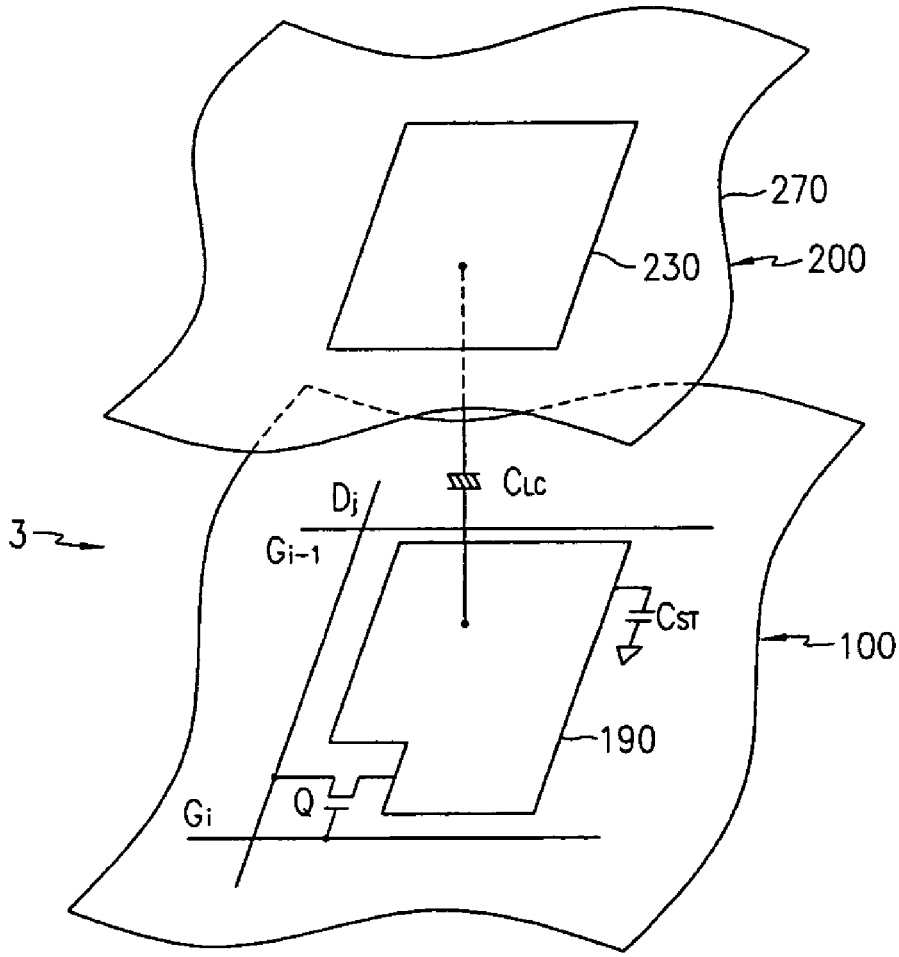
FIG. 2 is an equivalent circuit diagram of an exemplary embodiment of a pixel of an LCD according to the present invention.

FIG. 1 is a block diagram of an exemplary embodiment of an LCD according to the present invention, and FIG. 2 is an equivalent circuit diagram of an exemplary pixel of an LCD according to the present invention.

Referring to FIG. 1, an LCD includes an LC panel assembly 300, a gate driver 400, and a data driver 500 that are connected to the LC panel assembly 300, a gray voltage generator 800 connected to the data driver 500, and a signal controller 600 controlling the above elements.

Referring to FIG. 1, the LC panel assembly 300 includes a plurality of display signal lines G1-Gn and D1-Dm and a plurality of pixels connected thereto and arranged substantially in a matrix. In a structural view shown in FIG. 2, the panel assembly 300 includes lower and upper panels 100 and 200, respectively, and an LC layer 3 interposed therebetween.

The display signal lines G1-Gn and D1-Dm are disposed on the lower panel 100, and include a plurality of gate lines G1-Gn transmitting gate signals (also referred to as "scanning signals") and a plurality of data lines D1-Dm transmitting data signals. The gate lines G1-Gn extend substantially in a row direction and are substantially parallel to each other, while the data lines D1-Dm extend substantially in a column direction and are substantially parallel to each other. While the plurality of gate lines G1-Gn and the plurality of data lines D1-Dm cross over each other, they may be insulated from each other by an insulating layer on the lower panel 100.

Each pixel includes a switching element Q connected to the display signal lines G1-Gn and D1-Dm, and an LC capacitor $C_{LC}$ and a storage capacitor $C_{ST}$ connected to the switching element Q. The storage capacitor $C_{ST}$ may be omitted in certain embodiments.

The switching element Q, such as a TFT, is disposed on the lower panel 100. The switching element Q has three terminals including a control terminal connected to one of the gate lines G1-Gn, an input terminal connected to one of the data lines D1-Dm, and an output terminal connected to the LC capacitor $C_{LC}$ and the storage capacitor $C_{ST}$.

The LC capacitor $C_{LC}$ includes a pixel electrode 190 provided on the lower panel 100 and a common electrode 270 provided on the upper panel 200 as two terminals. The LC layer 3, disposed between the two electrodes 190, 270 functions as a dielectric of the LC capacitor $C_{LC}$. The pixel electrode 190 is connected to the switching element Q, and the common electrode 270 is supplied with a common voltage Vcom and covers an entire surface, or substantially the entire surface, of the upper panel 200. Alternatively, the common electrode 270 may be provided on the lower panel 100, and both electrodes 190 and 270 may have shapes of bars or stripes.

The storage capacitor $C_{ST}$ is an auxiliary capacitor for the LC capacitor $C_{LC}$. The storage capacitor $C_{ST}$ includes the pixel electrode 190 and a separate signal line provided on the lower panel 100. The storage capacitor $C_{ST}$ also overlaps the pixel electrode 190 via an insulator, and is supplied with a predetermined voltage such as the common voltage Vcom.

Alternatively, the storage capacitor $C_{ST}$ includes the pixel electrode 190 and an adjacent gate line called a previous gate line, which overlaps the pixel electrode 190 via an insulator.

For color display, each pixel uniquely represents one of three colors such as red, blue, and green (i.e., spatial division), or each pixel sequentially represents the colors in turn (i.e., temporal division) such that a spatial or temporal sum of the colors is recognized as a desired color. An example of a set of the colors includes red, green, and blue colors, and optionally white (or transparency). Another example of a set of the colors includes cyan, magenta, and yellow, which can be employed with or without red, green, and blue colors. FIG. 2 shows an example of the spatial division in which each pixel includes a color filter 230 representing one of the colors in an area of the upper panel 200 facing the pixel electrode 190. Alternatively, the color filter 230 is provided on or under the pixel electrode 190 on the lower panel 100.

One or more polarizers (not shown) are attached to at least one of the panels 100 and 200, such as on outer surfaces thereof.

Referring to FIG. 1 again, the gray voltage generator 800 generates two sets of a plurality of gray voltages related to the transmittance of the pixels. The gray voltages in one set have a positive polarity with respect to the common voltage Vcom, while the gray voltages in the other set have a negative polarity with respect to the common voltage Vcom.

The gate driver 400 is connected to the gate lines G1-Gn of the LC panel assembly 300, and synthesizes the gate-on voltage Von and the gate-off voltage Voff from an external device to generate gate signals for application to the gate lines G1-Gn.

The data driver 500 is connected to the data lines D1-Dm of the LC panel assembly 300 and applies data voltages, selected from the gray voltages supplied from the gray voltage generator 800, to the data lines D1-Dm.

The gate driver 400 or the data driver 500 may be implemented as an integrated circuit ("IC") chip mounted on the LC panel assembly 300 or as a flexible printed circuit ("FPC") film in a tape carrier package ("TCP") attached to the LC panel assembly 300. The gate driver 400 and the data driver 500 may be electrically connected to the gate lines G1-Gn and the data lines D1-Dm of the LC panel assembly 300 through signal lines formed on gate and data TCPs. Alternately, the drivers 400 and 500 may be integrated into the panel assembly 300 along with the display signal lines G1-Gn and D1-Dm and the TFT switching elements Q.

The signal controller 600 controls the gate driver 400 and the gate driver 500, as well as sending signals to a backlight assembly, etc. Now, the operation of the above-described LCD will be described in detail.

Referring to FIG. 1, the signal controller 600 is supplied with input red, green, and blue image data signals R, G, and B and input control data signals controlling the display thereof such as a vertical synchronization signal Vsync, a horizontal synchronization signal Hsync, a main clock MCLK, and a data enable signal DE from an external graphics controller (not shown). The signal controller 600 generates gate control signals CONT1 and data control signals CONT2 and processes the image data R, G, and B to be suitable for the operation of the panel assembly 300 on the basis of the input control data and the input image data R, G, and B. The signal controller 600 then provides the gate control signals CONT1 to the gate driver 400, the processed image data DAT as output image data, and the data control signals CONT2 to the data driver 500. Additionally, the signal controller 600 may generate backlight control signals and provide the backlight control signals to a backlight assembly.

The gate control signals CONT1 include a scanning start signal STV having instructions to start scanning and at least one clock signal for controlling the output time of the gate-on voltage Von. The gate control signals CONT1 may further include an output enable signal OE for defining the duration of the gate-on voltage Von.

The data control signals CONT2 include a horizontal synchronization start signal STH for informing the data driver 500 of a start of data transmission for a group of pixels, a load signal LOAD having instructions to apply the data voltages to the data lines D1-Dm, and a data clock signal HCLK. The data control signal CONT2 may further include an inversion signal RVS for reversing the polarity of the data voltages with respect to the common voltage Vcom.

In response to the data control signals CONT2 from the signal controller 600, the data driver 500 receives a packet of the output image data DAT, the processed image signals, for a pixel row from the signal controller 600, converts the output image data DAT into analog data voltages selected from the gray voltages supplied from the gray voltage generator 800, and applies the data voltages to the data lines D1-Dm.

In response to the gate control signals CONT1 from the signal controller 600, the gate driver 400 applies the gate-on voltage Von to the gate lines G1-Gn, thereby turning on the switching elements Q connected thereto. The data voltages applied to the data lines D1-Dm are supplied to the pixels through the activated switching elements Q.

The difference between the data voltage and the common voltage Vcom is represented as a voltage across the LC capacitor $C_{LC}$, referred to as a pixel voltage. The LC molecules in the LC capacitor $C_{LC}$ have orientations depending on the magnitude of the pixel voltage, and the molecular orientations determine the polarization of light passing through the LC layer 3. The polarizer(s) converts the light polarization into the light transmittance.

By repeating this procedure by a unit of the horizontal period (which is denoted by "1H" and is equal to one period of the horizontal synchronization signal Hsync and the data enable signal DE), all gate lines G1-Gn are sequentially supplied with the gate-on voltage Von during a frame, thereby applying the data voltages to all pixels. When the next frame starts after finishing one frame, the inversion control signal RVS, part of the data control signals CONT2, applied to the data driver 500 is controlled such that the polarity of the data voltages is reversed (which is referred to as "frame inversion"). The inversion control signal RVS may also be controlled such that the polarity of the data voltages flowing in a data line in one frame is reversed (for example, line inversion and dot inversion), or the polarity of the data voltages in one packet is reversed (for example, column inversion and dot inversion).

A frame frequency of the above-described LCD is about 120 Hz.

For this case, when the frame frequency is about 120 Hz, a driving method for decreasing a charging time of an LC will be described with reference to FIGS. 3 to 5.

Figure 3:
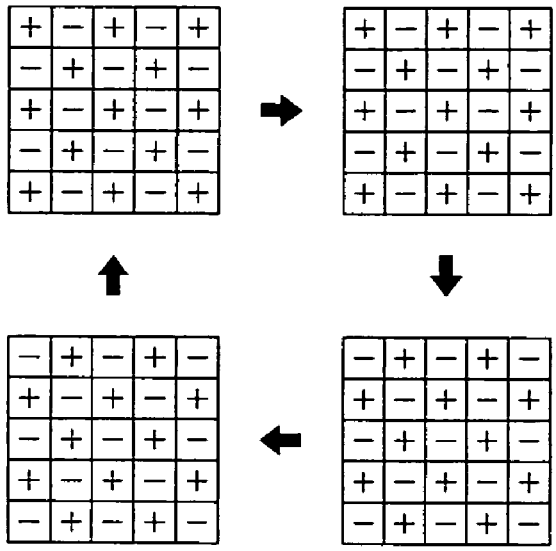
FIG. 3 illustrates an exemplary embodiment of a polarity state varying every other frame when an LCD is a one dot inversion type according to the present invention.
Figure 4A:
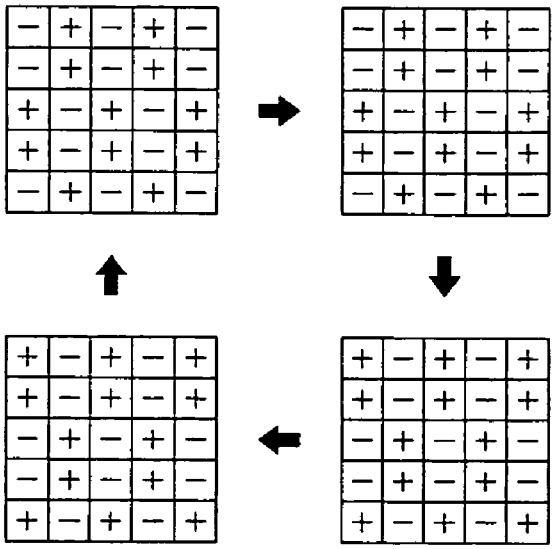
FIGS. 4A and 4B illustrate exemplary embodiments of a polarity state varying every other frame when an LCD is a two dot inversion type according to the present invention.
Figure 4B:
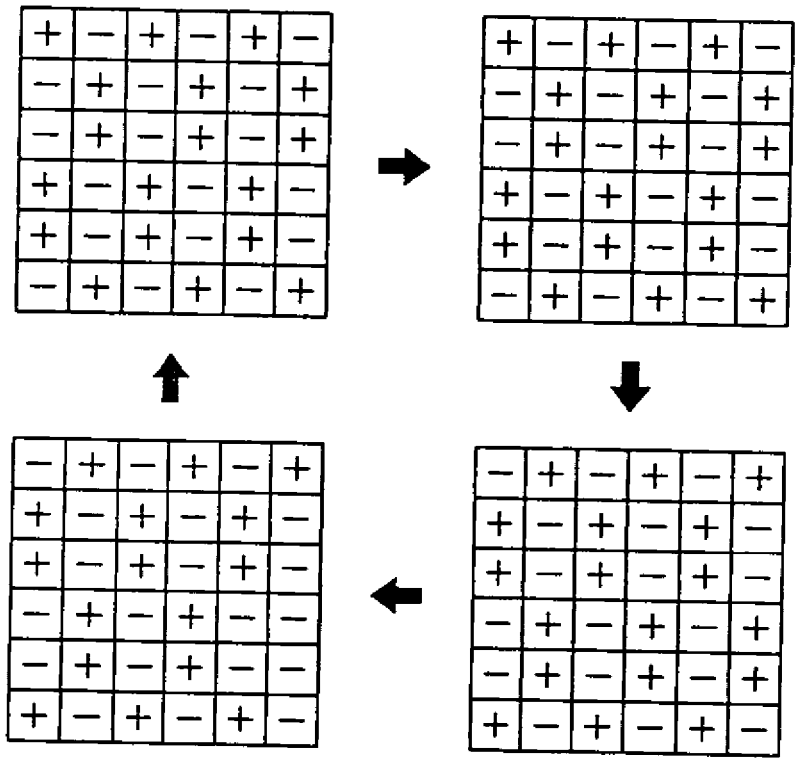

FIG. 3 illustrates an exemplary embodiment of a polarity state varying every other frame when an LCD is a one dot inversion type according to the present invention, and FIGS. 4A and 4B illustrate exemplary embodiments of a polarity state varying every other frame when an LCD is a two dot inversion type according to the present invention. FIG. 5 illustrates exemplary waveforms of signals used in the LCD shown in FIG. 3.

An LCD shown in FIG. 3 is a 1×1 dot inversion type, and an LCD shown in FIGS. 4A and 4B is a 2×1 dot inversion type.

As shown in FIGS. 3 to 4B, polarity of data voltages applied to the pixel electrodes 190 connected to the gate line G1-Gn remains the same and is not changed for two frames, thereby remaining in the same state, but the polarity is changed after the two frames. That is, the polarity of the data voltages is changed every two frames for applying them to the corresponding pixels through the data line D1-Dm. For example, a first frame and a second subsequent frame have the same polarity, but the polarity is changed for the third subsequent frame. A fourth subsequent frame has the same polarity as the third frame, but the polarity is changed for the fifth subsequent frame. The polarity of the fifth frame may be the same as the polarity of the first frame. A sixth subsequent frame has the same polarity of the fifth frame, and may further be the same as the polarity of the first and second frames, and so on.

When the frame frequency is about 120 Hz, a charging time of the LC capacitor $C_{LC}$ becomes shortened by half that of a 60 Hz frame frequency. By applying the data voltage of the same polarity for two frames, the shortened charging time is compensated.

That is, when the polarity of the data voltages is changed every frame, a charging voltage of the LC capacitor $C_{LC}$ has to reach a target voltage of opposite polarity, so a time to reach the target voltage become longer.

On the contrary, when the data voltages of the same polarity are applied for two successive frames, as shown in FIGS. 3 to 4*b*, a charging time in one frame of polarity different from an adjacent frame becomes short. However, a time to reach the target voltage in the other frame decreases since a data voltage of a polarity equal to the one frame is applied in another frame, to compensate the shortened charging time.

As described above, though the shortened charging time is compensated by using the two frame inversion type, not enough charging time is obtained due to a gate-on voltage delay and so on. Thus, as will be further described below, it is subjected to precharging before the application of the normal data voltage normally applied to the corresponding pixel for shortening the time to reach the target voltage.

Now, a precharging operation according to the present invention will be described with reference to FIGS. 5 and 6.

First, referring FIG. 5, an exemplary embodiment of a precharging operation of pixels of an LCD according to the present invention will be described.

Figure 5:
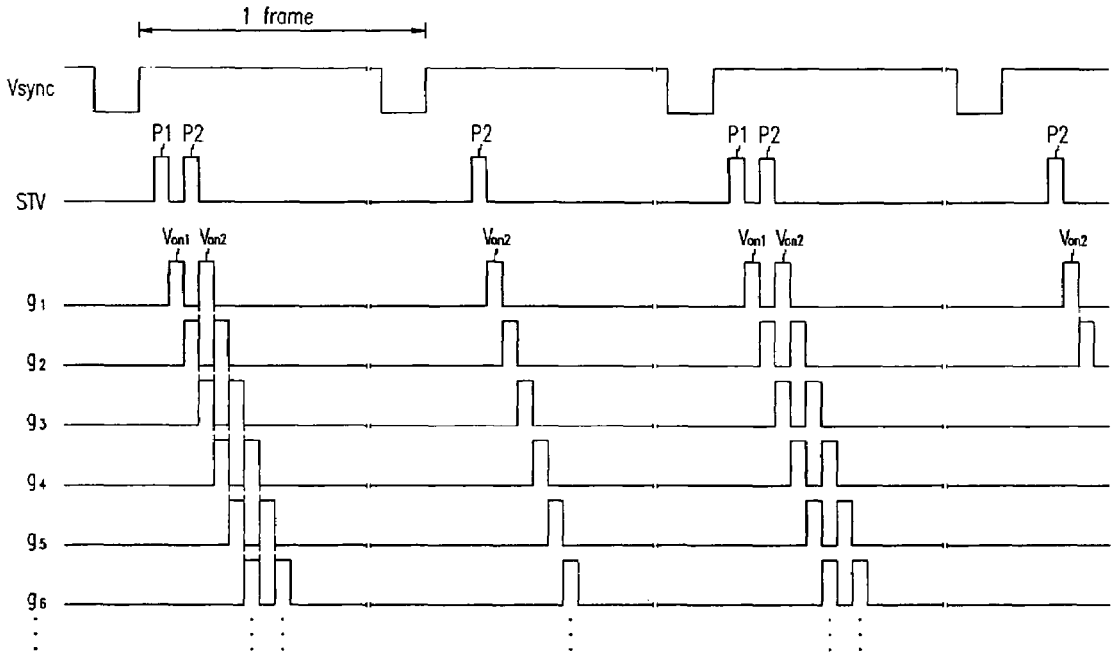
FIG. 5 illustrates exemplary waveforms of various signals used in the LCD shown in FIG. 3.

FIG. 5 illustrates exemplary waveforms of various signals used in the LCD shown in FIG. 3.

In FIG. 5, the gate-on voltage Von outputted to the gate lines G1-Gn in a present frame with a polarity different from a previous frame includes one precharging gate-on voltage Von1 and one main charging gate-on voltage Von2. As in the example described above, a third frame, which has a polarity different from the second frame, would include both the precharging gate-on voltage Von1 and the main charging gate-on voltage Von2.

After output of the precharging gate-on voltage Von1, the successive main charging gate-on voltage Von2 is outputted after a predetermined horizontal period, for example, 2H in the case of a 1 row inversion type or a 1×1 dot inversion type, or after a predetermined number of the gate lines, for example, 2 gate lines. However, the interval between the precharging gate-on voltage Von1 and the main charging gate-on voltage Von2 may be adjusted in consideration of variations of the pixel electrode voltage and so on.

The scanning start signal STV, within the gate control signal CONT1, includes a precharging pulse P1 for instructing the output of the precharging gate-on voltage Von1 and a main charging pulse P2 for instructing the output of the main charging voltage Von2. The interval between the preceding precharging pulse P1 and the successive main charging pulse P2 is equal, or at least substantially equal, to the interval between the precharging and main charging gate-on voltages Von1 and Von2.

However, in one frame with a polarity equal to that of a previous frame, the gate-on voltage Von outputted to the respective gate lines G1-Gn includes only the main charging gate-on voltage Von2. For example, as in the example described above, the fourth frame that has the same polarity as the third frame would include only the main charging gate-on voltage Von2, and would not include the precharging gate-on voltage Von1. The time when the main charging gate-on voltages Von2 are outputted in the previous frame and the present frame, respectively, are equal to each other. At this time, the scanning start signal STV also includes only the main charging pulse P2 for instructing the output of the main charging voltage Von2.

Now, an exemplary embodiment of a precharging operation of an LCD according to the present invention will be described in detail.

First, when an operation of a first frame is started by the vertical synchronizing signal Vsync, as indicated by the beginning of the section marked "1 frame" in FIG. 5, the signal controller 600 generates the precharging pulse P1 at the scanning start signal STV applied to the gate driver 400.

The gate driver 400 supplied with the precharging pulse P1 of the scanning start signal STV sequentially outputs the precharging gate-on voltage Von1, from the first gate line G1 connected to a first output terminal thereof. For example, the precharging pulse P1 of the scanning start signal STV may be supplied from t1 to t2 while the precharging gate-on voltage Von1 is, for example, applied to first gate line G1 from t2 to t3.

By the precharging gate-on voltage Von1, the respective pixel electrodes 190 sequentially connected to the first gate line G1 are supplied with the data voltages transmitted through the corresponding data lines D1-Dm, and thus the corresponding pixel is precharged.

After 2H or other predetermined horizontal period has elapsed, the signal controller 600 generates a main charging pulse P2 at the scanning start signal STV.

The gate driver 400 having received the main charging pulse P2 of the scanning start signal STV sequentially outputs the main charging gate-on voltage Von2, from the first gate line G1. For example, the main charging pulse P2 of the scanning start signal STV may be supplied from t3 to t4 while the main charging gate-on voltage Von2 is, for example, applied to first gate line G1 from t4 to t5. Thus, the pixel electrodes 190 connected to gate lines sequentially from the first gate line G1 are sequentially supplied with their own data voltages. That is, the pixels connected sequentially from the first gate line G1 are subjected to main charging for charging their own data voltage.

As described above, since the precharging gate-on voltage Von1 and the main charging gate-on voltage Von2 are outputted by 2H, respectively, the main charging voltage Von2 is outputted to the first gate line G1, and the precharging voltage Von1 is outputted to the third gate line G3. For example, both the main charging voltage Von2 applied to the first gate line G1 and the precharging voltage Von1 applied to the third gate line G3 occur at t4. In result, the pixel electrodes 190 connected to the third gate lines G3 are supplied with data voltages equal to data voltages applied to the pixel electrodes 190 connected to the first gate line G1.

That is, the pixel electrodes 190 connected to the first and second gate lines G1 and G2 are supplied with data voltages of predetermined values stored into an internal memory (not shown) through the data driver 500, thereby being precharged. However, the pixel electrodes 190 connected to gate lines from the third gate line G3 are precharged by data voltages applied to the pixel electrodes 190 connected to the gate lines before 2H gate lines, that is, two gate lines. That is, for example, the pixel electrodes 190 connected to gate line G4 are precharged by data voltages applied to the pixel electrodes 190 connected to gate line G2, the pixel electrodes 190 connected to gate line G5 are precharged by data voltages applied to the pixel electrodes 190 connected to gate line G3, etc.

Next, when an operation of a second frame, where the second frame follows the first frame indicated by the second marked "1 frame" in FIG. 5, is started by the vertical synchronizing signal Vsync, the signal controller 600 generates the main charging pulse P2 at the scanning start signal STV applied to the gate driver 400.

As described above, the generation time of the main charging pulse P2 is equal to that of the main charging pulse P2 in the first frame.

The gate driver 400, having received the main charging pulse P2 of the scanning start signal STV, sequentially outputs the main charging gate-on voltage Von2, from the first gate line G1 connected to a first output terminal thereof. By the main charging voltage Von2, the respective pixel electrodes 190 connected to gate lines sequentially from the first gate line G1 are sequentially supplied with their own data voltages. That is, the pixels connected sequentially from the first gate line G1 are subjected to main charging for charging their own data voltage. For example, after the main charging pulse P2, the main charging gate-on voltage Von2 is applied to first gate line G1, then second gate line G2, then third gate line G3, etc.

Thus, in the second frame, after all the pixel electrodes 190 are supplied with their own data voltages, in starting the operation of a third frame by the vertical synchronizing signal Vsync, the pixel electrodes 190 connected to the gate lines G1-Gn are precharged and main charged by the same driving method as that in the first frame.

In a frame for which the polarity of data voltages is opposite to the polarity of data voltages for a previous frame, the pixel electrodes 190 connected to all the gate lines G1-Gn are subjected to precharging as well as main charging. Thus, by the precharging, the time delay to a target voltage due to polarity inversion of the applied data voltage is compensated. Also, in a frame for which the polarity of data voltages is the same as the polarity of data voltages for a previous frame, the pixel electrodes 190 connected to all the gate lines G1-Gn are subjected only to main charging.

Now, another exemplary embodiment of a precharging operation of an LCD according to the present invention will be described with reference to FIG. 6.

Figure 6:
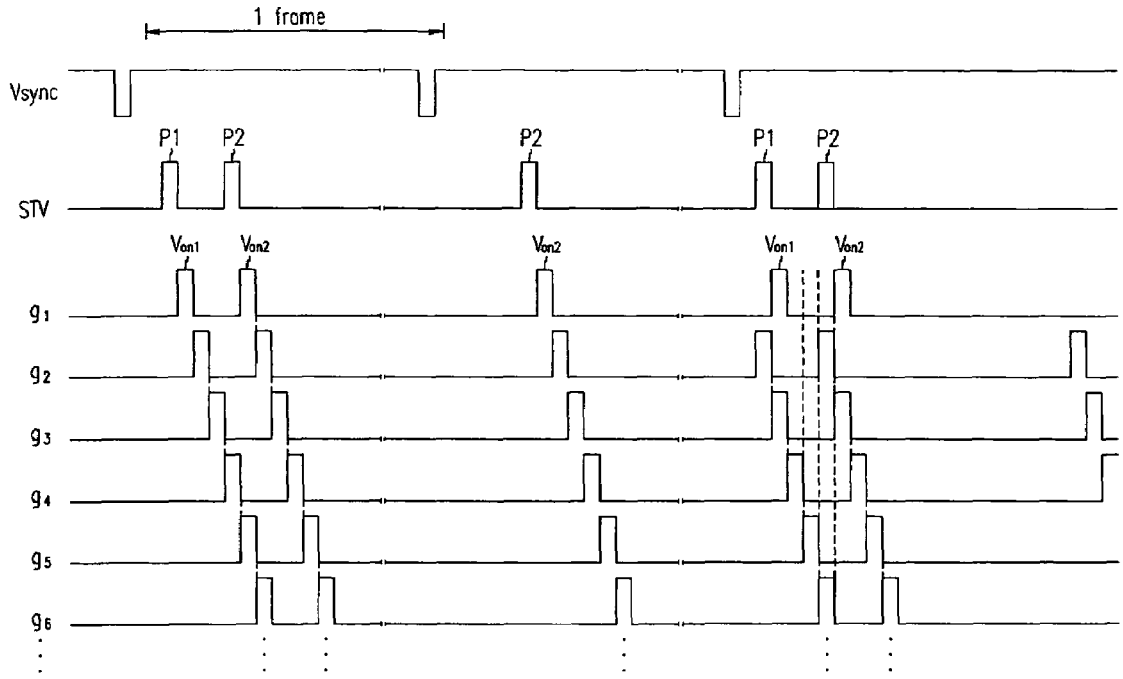
FIG. 6 illustrates exemplary waveforms of various signals used in the LCD shown in FIGS. 4A and 4B.

FIG. 6 illustrates exemplary waveforms of various signals used in the LCD shown in FIGS. 4A and 4B.

As in FIG. 5, in a frame for which the polarity of data voltages is opposite to the polarity of data voltages for a previous frame, a gate-on voltage Von shown in FIG. 6 includes a precharging gate-on voltage Von1 and a main charging gate-on voltage Von2, and the scanning start signal STV includes one precharging pulse P1 and one main charging pulse P2. In a frame for which the polarity of data voltages is equal to the polarity of data voltages for a previous frame, a gate-on voltage Von includes only the main charging gate-on voltage Von2, and the scanning start signal STV includes one main charging pulse P2.

For precharging corresponding pixel electrodes 190 by using data voltages of a polarity equal to the polarity of data voltages for main charging, the generation times of the precharging pulse P1 and the main charging pulse P2 are different from each other, and the output times of the precharging gate-on voltage Von1 and the main charging gate-on voltage Von2 based on the precharging pulse P1 and the main charging pulse P2 are also different from each other.

After output of the precharging pulse P1, the main charging pulse P2 is outputted after 4H or four gate lines since the LCD according to this embodiment of the present invention is a 2×1 dot inversion type. However, the interval between the precharging pulse P1 and the main charging pulse P2 may be adjusted in consideration of variations of the pixel electrode voltage and so on. In this case, since the output times of the gate-on voltages Von1 and Von2 are synchronized with the precharging and main charging pulses P1 and P2, respectively, the interval between the gate-on voltages Von1 and Von2 is equal to, or at least substantially equal to, the interval between the pulses P1 and P2.

Since the precharging gate-on voltage Von1 and the main charging gate-on voltage Von2 are outputted by 4H, respectively, the main charging gate-on voltage Von2 is outputted to the first gate line G1, and the precharging gate-on voltage Von1 is outputted at the same time to the fifth gate line G5. For example, assuming the precharging pulse P1 occurs from t1 to t2, the precharging gate-on voltage Von1 is applied to the first gate line G1 from t2 to t3, the precharging gate-on voltage Von1 is applied to the second gate line G2 from t3 to t4, the precharging gate-on voltage Von1 is applied to the third gate line G3 from t4 to t5, the precharging gate-on voltage Von1 is applied to the fourth gate line G4 from t5 to t6, and the precharging gate-on voltage Von1 is applied to the fifth gate line G5 from t6 to t7, then the main charging gate-on voltage Von2 is also applied to the first gate line G1 from t6 to t7. As a result, the pixel electrodes 190 connected to the fifth gate line G5 are supplied with data voltages equal to data voltages applied to the pixel electrodes 190 connected to the first gate line G1.

That is, the pixel electrodes 190 connected from the first to fourth gate lines G1-G4 are supplied with data voltages of predetermined values stored in an internal memory (not shown) through the data driver 500, thereby being precharged. However, the pixel electrodes 190 connected to gate lines from the fifth gate line G5 are precharged by data voltages applied to the pixel electrodes 190 connected to the gate lines before 4H gate lines, that is, four gate lines. That is, for example, the pixel electrodes 190 connected to gate line G6 are precharged by data voltages applied to the pixel electrodes 190 connected to gate line G2, the pixel electrodes 190 connected to gate line G7 are precharged by data voltages applied to the pixel electrodes 190 connected to gate line G3, etc.

In a frame for which the polarity of data voltages is opposite the polarity of data voltages for a previous frame, the pixel electrodes 190 connected to all the gate lines G1-Gn are subjected to precharging as well as main charging. Thus, by the precharging, the time delay to a target voltage due to polarity inversion of the applied data voltage is compensated. Also, in a frame for which the polarity of data voltages is the same as the polarity of data voltages for a previous frame, the pixel electrodes 190 connected to all the gate lines G1-Gn are subjected only to main charging.

Now, referring to FIGS. 7 and 8, when a frame frequency of an LCD is changed from about 60 Hz to about 120 Hz, a luminance variation of an exemplary embodiment of an LCD according to the present invention will be described.

Figure 7:
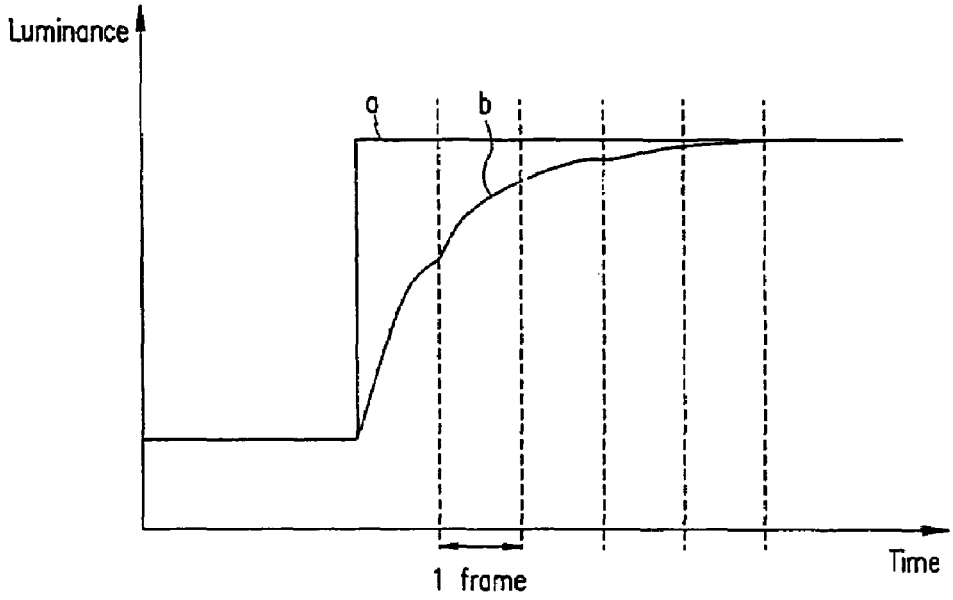
FIG. 7 is a graph illustrating luminance variation with respect to time when a frame frequency is about 120 Hz.
Figure 8:
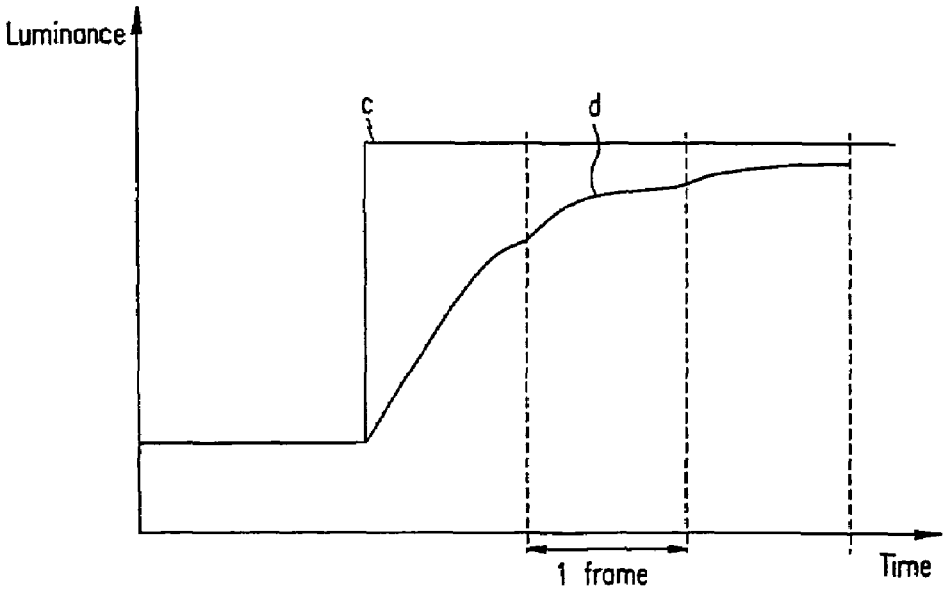
FIG. 8 is a graph illustrating luminance variation with respect to time when a frame frequency is about 60 Hz.

FIG. 7 is a graph illustrating luminance variation with respect to time when a frame frequency is about 120 Hz, and FIG. 8 is a graph illustrating luminance variation with respect to time when a frame frequency is about 60 Hz.

As shown in FIG. 7, since the time of one frame is decreased by half as compared to the case shown in FIG. 8, a time until the luminance "b" of an LCD reaches the target luminance "a" is shortened.

That is, as shown in FIGS. 7 and 8, when data voltages are applied to corresponding pixel electrodes to obtain a target luminance, the luminance variation ratio of an LCD is decreased as time elapses, where the luminance variation ratio represents a comparison of the actual luminance, such as "b" and "d", to the target luminance, such as "a" and "c", in FIGS. 7 and 8, respectively.

The maintaining time of one frame decreases as the frame frequency increases. Thus, as shown in FIG. 8, as time elapses, the luminance variation ratio for reaching the target luminance is decreased, and thereby a time until the luminance "d" of an LCD reaches the target luminance "c" becomes longer than that of the case shown in FIG. 7. In addition, since the maintaining time of every frame becomes shorter, flickering is decreased.

In embodiments of the present invention, the precharging and main charging are subjected in odd frames and the main charging is subjected in even frames, but the main charging may be subjected in the odd frames and the precharging and main charging may be subjected in the even frames. In other words, precharging and main charging are subjected to alternating frames, while every other frame only has main charging.

In addition, in embodiments of the present invention, the inversion type is a 1×1 dot inversion type or a 2×1 dot inversion type and a two frame inversion type, but different inversion types may be adapted. That is, when the inversion type is an N row inversion type or an N×M dot inversion type, after output of the main charging gate-on voltage, a precharging gate-on voltage is transmitted to the (2N+1)th gate line in a frame for which polarity of data voltages is changed.

Moreover, in embodiments of the present invention, the number of precharging gate-on voltages is one, but the number of the precharging gate-on voltages may be varied and may be a plurality of precharging gate-on voltages applied prior to the main gate-on voltage. At this time, when the precharging gate-on voltages and the main charging gate-on voltage are outputted, the polarities of data voltages applied to corresponding pixel electrodes are equal to each other. Thus, the interval between the adjacent precharging gate-on voltages is by even horizontal periods or even gate lines.

According to the present invention, although a frame frequency increases to about 120 Hz, image quality deterioration due to a lack of charging time decreases and flickering is decreased.

Since the precharging is subjected before the main charging, image quality deterioration due to a lack of charging time decreases and flickering is decreased in a frame for which polarity of data voltages is changed.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A display device comprising:

a plurality of pixels;

a gate driver applying gate signals to the pixels;

a data driver applying data voltages to the pixels; and a signal controller outputting a plurality of control signals for controlling the gate driver and the data driver, wherein polarity of a data voltage applied to at least one pixel is changed at least every two frames, each gate signal comprises a gate-off voltage, a first gate-on voltage, and a second gate-on voltage, and the gate driver outputs the second gate-on voltage after a predetermined time has elapsed from the first gate-on voltage, and the first gate-on voltage is outputted only when the polarity of the data voltage applied to the at least one pixel for a frame is opposite to a polarity of a data voltage applied in a previous frame, and the second gate-on voltage is outputted without the first gate-on voltage when the polarity of the data voltage for the frame is equal to the polarity of the data voltage for the previous frame.

2. The display device of claim 1, wherein the display device has a frame frequency of 120 Hz.

3. The display device of claim 1, wherein the display device is a 1×1 dot inversion type.

4. The display device of claim 3, wherein the predetermined time is 2H.

5. The display device of claim 1, wherein the display device is a 2×1 dot inversion type.

6. The display device of claim 5, wherein the predetermined time is 4H.

7. The display device of claim 1, wherein the plurality of control signals includes an inversion signal, and the data driver inverts the polarity of the data voltage based on the inversion signal.

8. The display device of claim 1, wherein the plurality of control signals includes a scanning start signal, and the scanning start signal includes a first pulse for instructing output of the first gate-on voltage and a second pulse for instructing output of the second gate-on voltage.

9. The display device of claim 1, wherein the first gate-on voltage is a precharging gate-on voltage, and the second gate-on voltage is a main charging gate-on voltage.

10. The display device of claim 9, further comprising a plurality of precharging gate-on voltages within each gate signal.

11. The display device of claim 1, wherein the display device is a liquid crystal display.

12. The display device of claim 1, wherein the polarity of a data voltage applied to the at least one pixel is same for even frames, and is opposite for odd frames.

13. The display device of claim 1, wherein the polarity of a data voltage applied to the at least one pixel alternates between being same for n consecutive frames and opposite for m consecutive frames, where n and m are greater than or equal to two.

14. The display device of claim 13, wherein n is equal to m.

15. A driving method of a display device including a plurality of pixels connected to a plurality of gate lines and a plurality of data lines, the method comprising:

applying a data voltage to the data lines;

applying a first gate-on voltage and a second gate-on voltage to a first gate line, to apply data voltages to pixels connected to the first gate line when a polarity of a data voltage for a frame is different from a polarity of data voltages for a previous frame; and applying the second gate-on voltage without the first gate-on voltage to the first gate line, to apply data voltages to pixels connected to the first gate line when a polarity of the data voltage for a frame is equal to a polarity of data voltages for a previous frame.

16. The driving method of claim 15, wherein the display device is an N row inversion type and the gate driver transmits the first gate-on voltage by (2N)H before transmission of the second gate-on voltage.

17. The driving method of claim 16, wherein data voltages applied at adjacent data lines have polarities opposite to each other.

18. The driving method of claim 17, wherein the display device is a 1×1 dot inversion type.

19. The driving method of claim 17, wherein the display device is a 2×1 dot inversion type.

20. The driving method of claim 15, wherein the display device has a frame frequency of 120 Hz.

21. The driving method of claim 15, further comprising, when the polarity of a data voltage for a frame is different from the polarity of a data voltage for a previous frame, applying a first gate-on voltage and a second gate-on voltage to a second gate line, and applying a first gate-on voltage and a second gate-on voltage to a third gate line, wherein the first gate-on voltage applied to the third gate line is same as the second gate-on voltage applied to the first gate line.

22. The driving method of claim 15, further comprising, when the polarity of a data voltage for a frame is different from the polarity of a data voltage for a previous frame, applying a first gate-on voltage and a second gate-on voltage to a fifth gate line, wherein the first gate-on voltage applied to the fifth gate line is same as the second gate-on voltage applied to the first gate line.

23. A display device comprising:

at least one pixel, wherein a polarity of a data voltage applied to the at least one pixel alternates between being same for at least two consecutive frames and opposite for at least two consecutive frames;

wherein, when a polarity of the data voltage applied to the at least one pixel in an mth frame is opposite to a polarity of the data voltage applied in a previous frame, a precharging gate-on voltage and a main charging gate-on voltage are applied to a first gate line of the display device, and when a polarity of the data voltage applied to the at least one pixel in an nth frame is same as a polarity of the data voltage applied in a previous frame, a main charging gate-on voltage is applied to the first gate line without the precharging gate-on voltage.

24. The display device of claim 23, further comprising a plurality of precharging gate-on voltages applied to the first gate line during the mth frame.

25. The display device of claim 23, wherein the main charging gate-on voltage is applied subsequent the precharging gate-on voltage after a predetermined horizontal period.

* * * * *